US010202776B1

(12) United States Patent
Lanuza

(10) Patent No.: US 10,202,776 B1
(45) Date of Patent: Feb. 12, 2019

(54) EXPANDER FOR FASTENING TRACK FOR FABRIC WALL COVERINGS

(71) Applicant: Craig Lanuza, Ventura, CA (US)

(72) Inventor: Craig Lanuza, Ventura, CA (US)

( * ) Notice: Subject to any disclaimer, the term of this patent is extended or adjusted under 35 U.S.C. 154(b) by 0 days.

(21) Appl. No.: 15/786,942

(22) Filed: Oct. 18, 2017

(51) Int. Cl.

| | |
|---|---|
| ***E04F 13/26*** | (2006.01) |
| ***E04F 13/00*** | (2006.01) |
| *D21H 27/20* | (2006.01) |
| *E04B 9/30* | (2006.01) |
| *E04D 5/14* | (2006.01) |

(52) U.S. Cl.
CPC ..... *E04F 13/26* (2013.01); *E04F 13/005* (2013.01); *D21H 27/20* (2013.01); *E04B 9/303* (2013.01); *E04D 5/147* (2013.01)

(58) Field of Classification Search
CPC ..... B44D 3/185; E04B 9/303; E06B 9/521; B44C 7/022
USPC ..... 160/327
See application file for complete search history.

(56) References Cited

U.S. PATENT DOCUMENTS

| | | | | |
|---|---|---|---|---|
| 4,197,686 | A * | 4/1980 | Baslow | B44C 7/022 160/327 |
| 4,986,332 | A * | 1/1991 | Lanuza | B44C 7/022 160/327 |
| 5,214,891 | A * | 6/1993 | Edlin | B44C 7/022 160/327 |
| 6,283,247 | B1 * | 9/2001 | McGrath | B44C 7/022 181/295 |
| 6,324,797 | B1 * | 12/2001 | Fago | E04B 9/306 160/327 |
| 2005/0139334 | A1 * | 6/2005 | Bernardi | E04B 9/303 160/378 |
| 2008/0136079 | A1 * | 6/2008 | Bernardi | E04B 9/303 269/257 |
| 2010/0206496 | A1 * | 8/2010 | Ninaber | B29C 47/0019 160/372 |

FOREIGN PATENT DOCUMENTS

| | | | | |
|---|---|---|---|---|
| CA | 2484907 | A1 * | 4/2005 | E04B 9/303 |
| DE | 10234317 | A1 * | 3/2004 | E04B 9/0428 |
| FR | 2461137 | A1 * | 1/1981 | B44C 7/022 |
| FR | 2505020 | A1 * | 11/1982 | A47G 1/06 |

(Continued)

*Primary Examiner* — Babajide A Demuren
(74) *Attorney, Agent, or Firm* — Sandy Lipkin

(57) ABSTRACT

An expander member for use with fastening track for fabric wall coverings that allows for wider distances between the fabric and the wall to be covered. The invention allows for top loading of fabric as well as side loading. The expander includes a series of grooves that allow for fastening of the member to a wall as well as for fastening to additional members proximate the top and bottom as desired. Alternatively, one or more pocket holes can be used to secure the member to a wall using a fastening screw. In the preferred embodiment first flange extends outward from the member with a height shorter than the member forming a groove therebetween for the placement therein of the fastening track. An alternate embodiment includes a second top flange that is proximate the top side and the back that has a length shorter than the top side creating a groove therebetween for the placement therein of a second fastening track that allow for fabric to horizontally stretch atop the member a desired.

3 Claims, 17 Drawing Sheets

(56) References Cited

FOREIGN PATENT DOCUMENTS

| | | | | | |
|---|---|---|---|---|---|
| FR | 2630476 | A1 | * | 10/1989 | ..... B44C 7/022 |
| FR | 2686109 | A1 | * | 7/1993 | ..... B44C 7/022 |
| FR | 2998316 | A1 | * | 5/2014 | ..... E04B 9/303 |
| GB | 2401580 | A | * | 11/2004 | ..... A47F 7/163 |
| WO | WO-9923321 | A1 | * | 5/1999 | ..... B44C 7/022 |
| WO | WO-0059738 | A1 | * | 10/2000 | ..... B44C 7/022 |

* cited by examiner

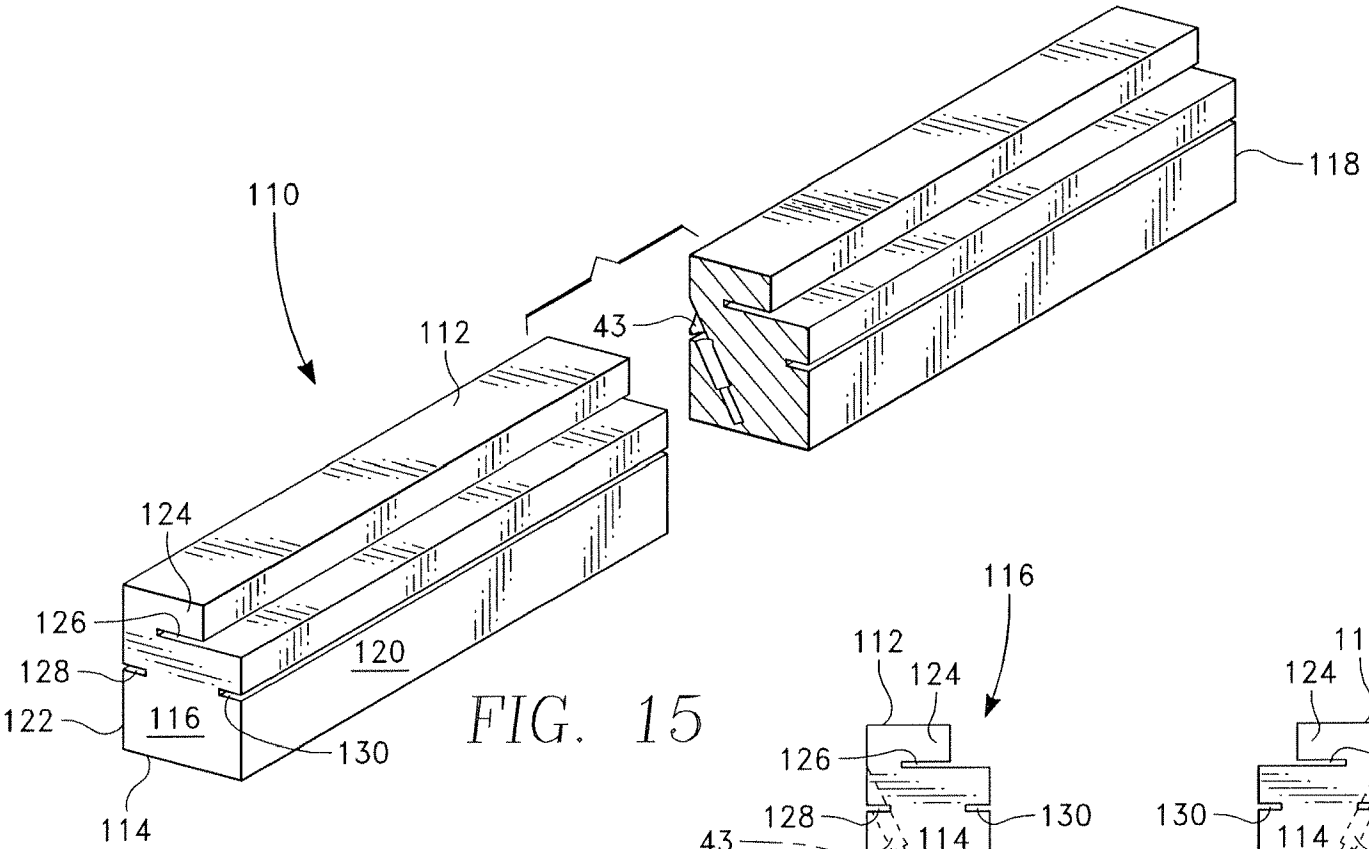
FIG. 15
FIG. 16
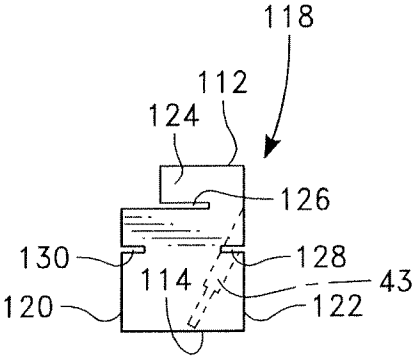
FIG. 17

EXPANDER FOR FASTENING TRACK FOR FABRIC WALL COVERINGS

REFERENCE TO PRIOR APPLICATION

This application claims priority of the design patent application Ser. No. 29/613,603, filed Aug. 11, 2017 entitled EXPANDER FOR FASTENING TRACK FOR FABRIC WALL COVERINGS by Craig Lanuza.

BACKGROUND OF THE INVENTION

Field of the Invention

The field of this invention relates generally to the field of fabric wall coverings and more specifically toward expander pieces that provide for thicker fabric wall coverings adapted for use with existing technologies for fastening track assemblies for fabric wall coverings.

Description of the Prior Art

Fabric wall coverings are used for both acoustic and aesthetic purposes. The prior patent to the instant inventor Lanuza, U.S. Pat. No. 4,986,332. revolutionized the industry in that fastening track assemblies are now produced that are composed of first, second and third tracks of extruded polyvinyl chloride plastic which, when intermeshed create a framework for stretching and securing fabrics of varying thicknesses, onto a wall surface. The first extruded track is fastened to the wall surface with screws. The second or third extruded track is snapped into the first track creating a set of working jaws and a fabric storage slot. A sheet of fabric is then stretched around the wall perimeter, with the excess fabric being tucked and secured through the working jaws and into the fabric storage slot. Latest generation versions of the device as developed by Lanuza no longer require three parts. The fastening track is now an integral piece with the working jaws form thereon. Furthermore, the fastening tracks in use now not only come with a rectangular profile providing a flat planar surface upon which the fabric can rest, but angled beveled edges are also supplied for many customized applications.

Occasionally, larger thicknesses are desired between the wall and the fabric. It is the object of the instant invention to provide expanders for use with latest generations of the '332 patent device that extends the covering 2" or 4" or any thickness desired from the wall to the fabric.

It is a further object of the instant invention to provide the expanders to load the fabric from both the top of the device and from the side of the device, as desired by the user.

SUMMARY OF THE INVENTION

The basic embodiment of the present invention teaches An expander device for use with fastening track for fabric wall coverings comprising: an elongated main body that has a substantially rectangular profile and further comprising a front side, a back side, a first end, a second end, a top side and a bottom side; and a front flange extending outward from said front side and having a height that is shorter than said front side and offset slightly therefrom thereby creating a first flange groove therebetween.

The above embodiment can be further modified by defining that at least one set of parallel grooves running parallel to each other along said top side and bottom side respectively.

The above embodiment can be further modified by defining that a fastening track is placed in said first flange groove thereby allowing for the securing of fabric therein wherein said fabric extends vertically down from said expander device substantially flush with said front side.

The above embodiment can be further modified by defining that a securing piece for securing said device to a wall, said securing piece comprising a first side that is substantially planar attached to a second side that is substantially planar and positioned substantially perpendicular to said first side along one edge of said first side and a third side that is substantially planar and positioned substantially perpendicular to said second side along an opposite parallel side from said first side and substantially parallel to said first side yet extending upward in the direction opposite of the direction between said first and second sides wherein said third side fits into one of said parallel grooves on said bottom side of said member and said first side is secured to a wall or other planar surface.

The above embodiment can be further modified by defining that a second top flange positioned substantially perpendicular to said front flange and positioned proximate said top side having a length shorter than the length of said top side and offset slightly therefrom thereby creating a second flange groove therebetween.

The above embodiment can be further modified by defining that a fastening track is placed in said second top flange groove thereby allowing for the securing of fabric therein wherein said fabric extends horizontally across said top side.

The above embodiment can be further modified by defining that one or more apertures are found along said bottom side of said member wherein said one or more apertures has an angled axis of entry for the securing therein of a screw wherein said one or more apertures extend through to said back side for securing of said member to a wall.

BRIEF DESCRIPTION OF THE DRAWINGS

For a better understanding of the present invention, reference is to be made to the accompanying drawings. It is to be understood that the present invention is not limited to the precise arrangement shown in the drawings.

FIG. 15 is perspective view of the two inch top loader embodiment of the instant invention.

FIG. 16 is a first side view of the two inch top loader embodiment of the instant invention.

FIG. 17 is a second side view of the two inch top loader embodiment of the instant invention.

DETAILED DESCRIPTION OF A PREFERRED EMBODIMENT

Glossary of Terms

Figures 1, 2, 3:
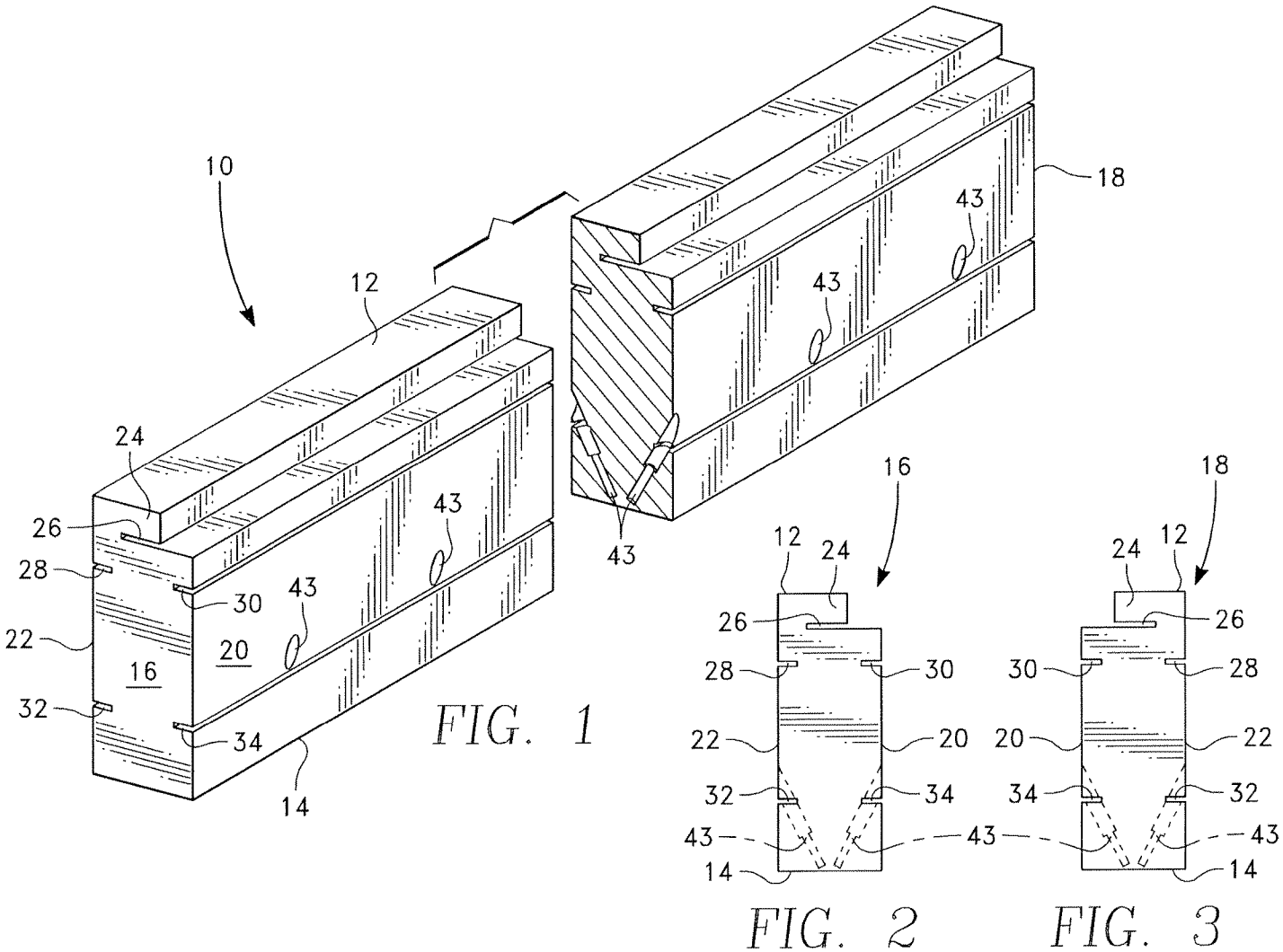
FIG. 1 is a perspective view of the four inch top loader embodiment of the instant invention.
FIG. 2 is a first side view of the four inch top loader embodiment of the instant invention.
FIG. 3 is a second side view of the four inch top loader embodiment of the instant invention.
Figure 4:
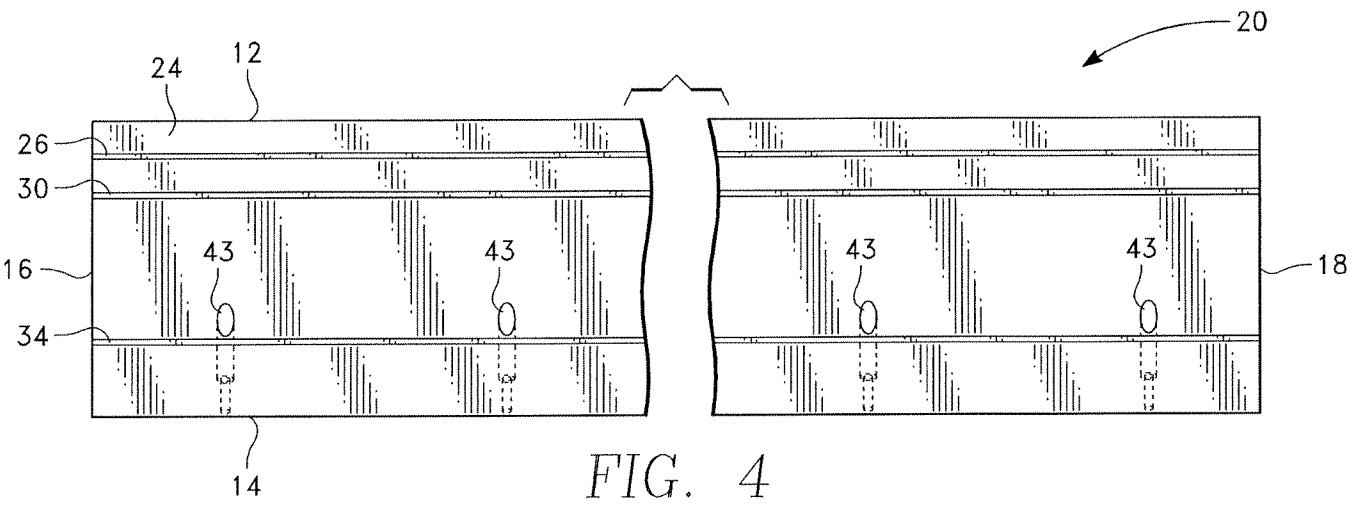
FIG. 4 is front side view of the four inch top loader embodiment of the instant invention.
Figure 5:
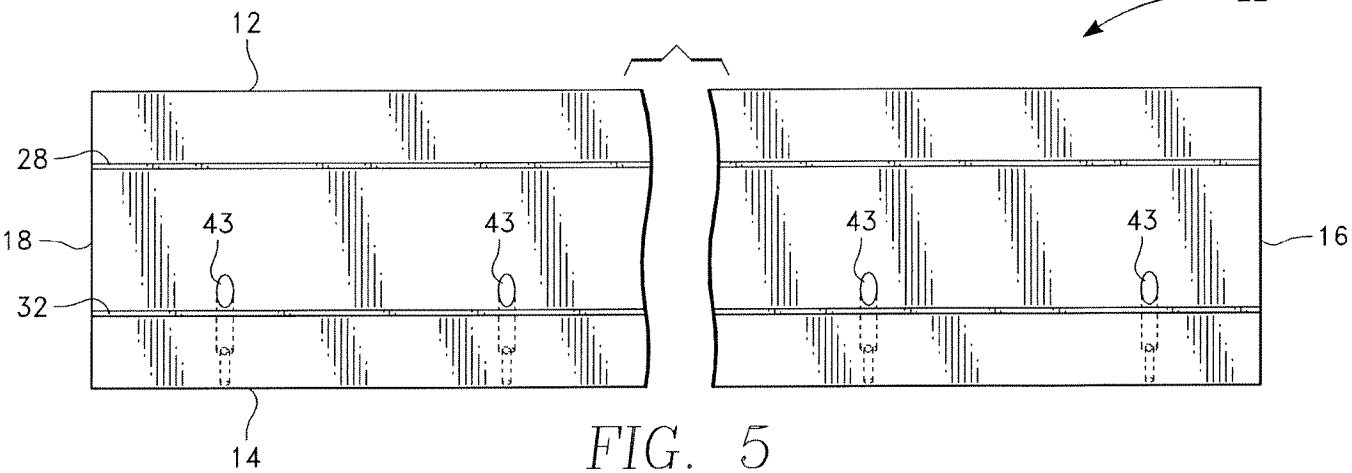
FIG. 5 is a back side view of the four inch top loader embodiment of the instant invention.
Figure 6:
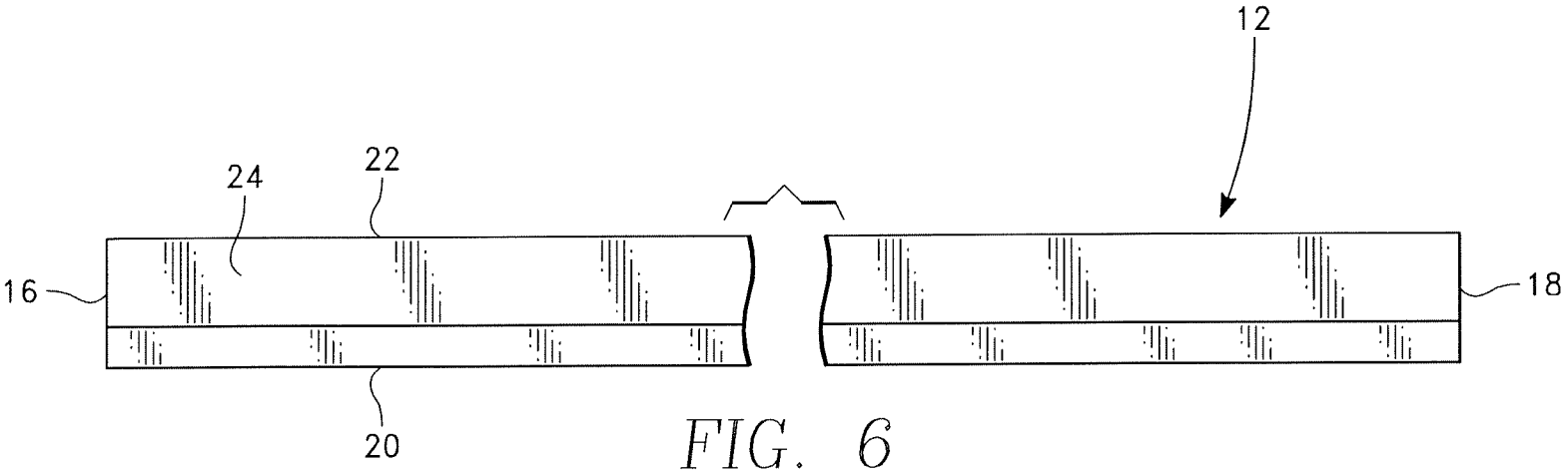
FIG. 6 is a top view of the four inch top loader embodiment of the instant invention.
Figure 7:
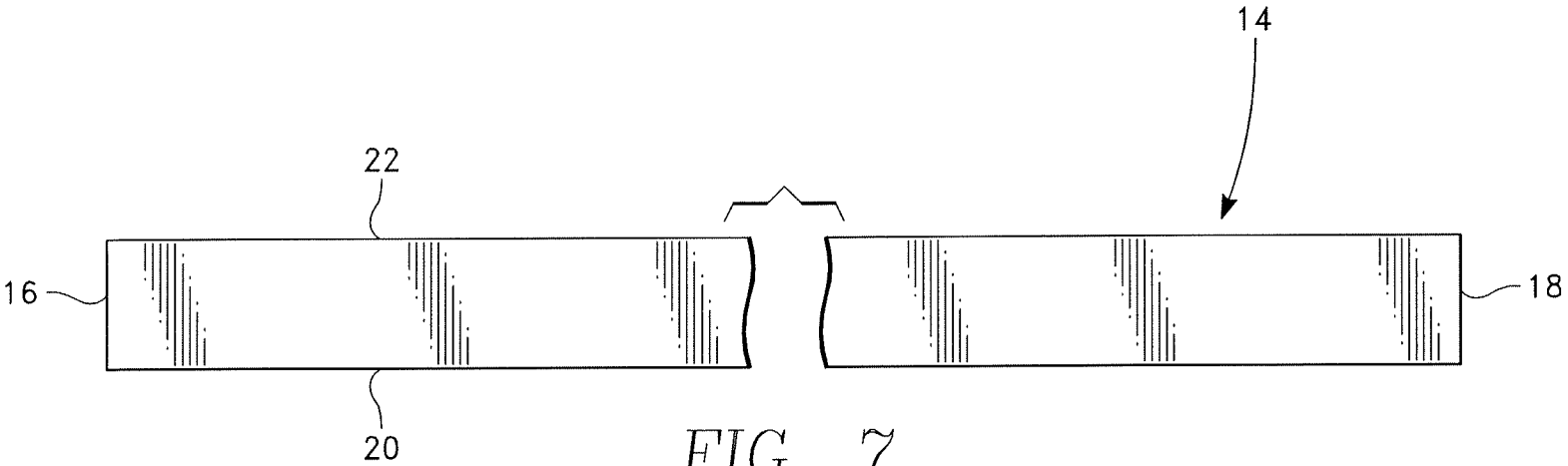
FIG. 7 is a bottom view of the four inch top loader embodiment of the instant invention.
Figures 8, 9, 10:
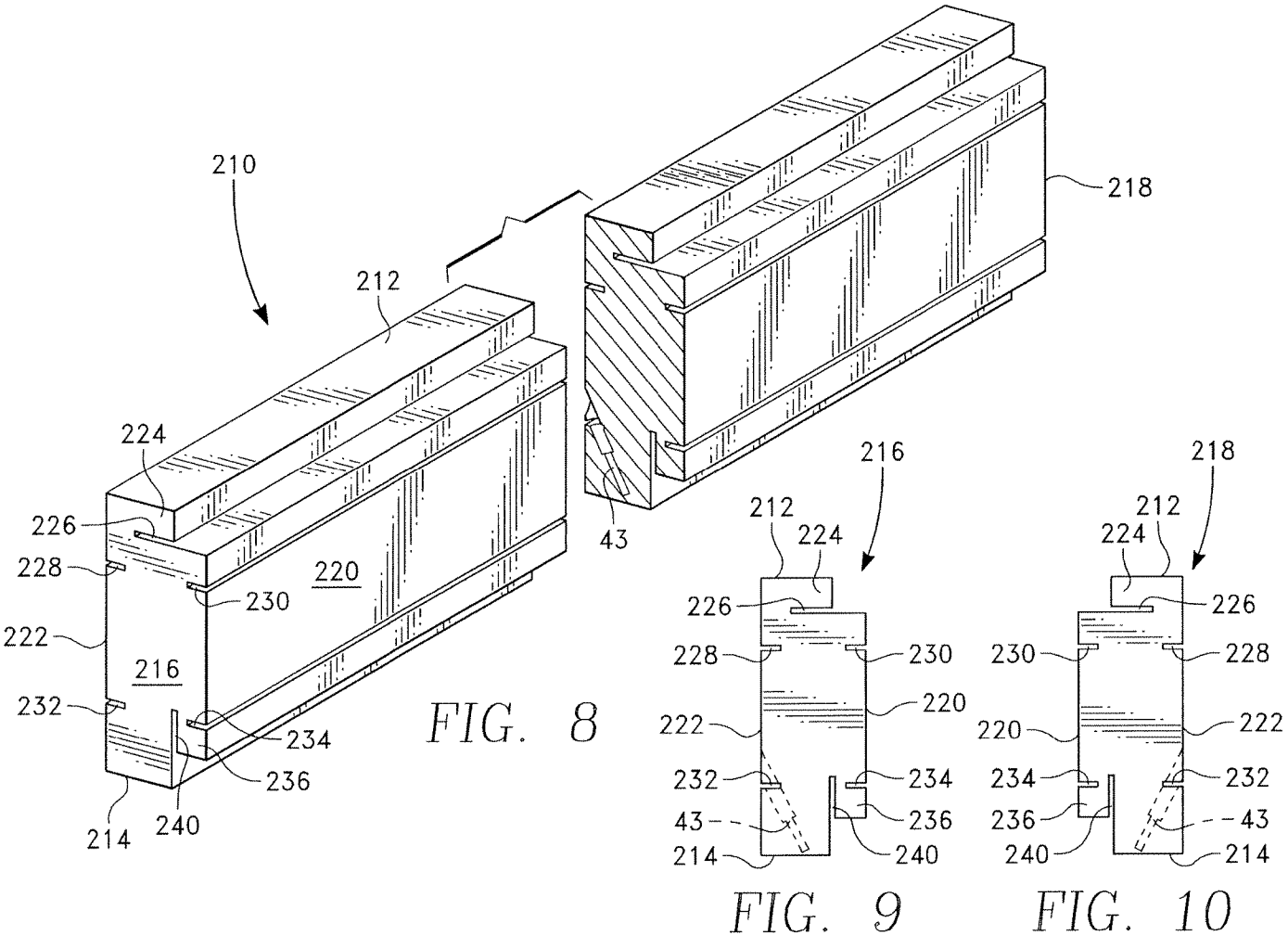
FIG. 8 is a perspective view of the four inch side loader embodiment of the instant invention.
FIG. 9 is a first side view of the four inch side loader embodiment of the instant invention.
FIG. 10 is a second side view of the four inch side loader embodiment of the instant invention.
Figure 11:
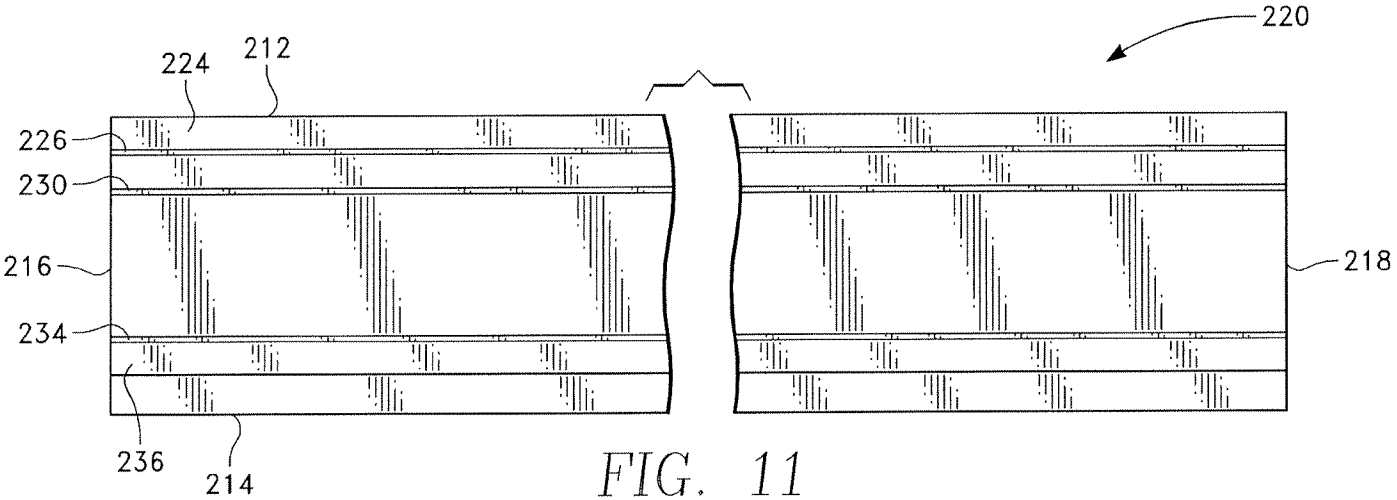
FIG. 11 is a front side view of the four inch side loader embodiment of the instant invention.
Figure 12:
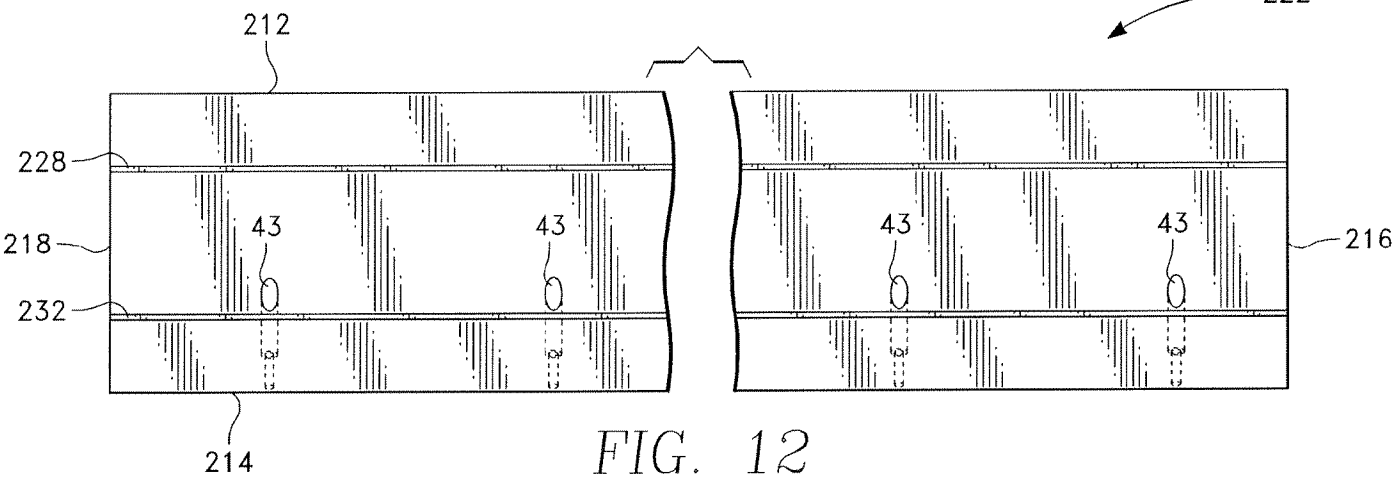
FIG. 12 is a back side view of the four inch side loader embodiment of the instant invention.
Figure 13:
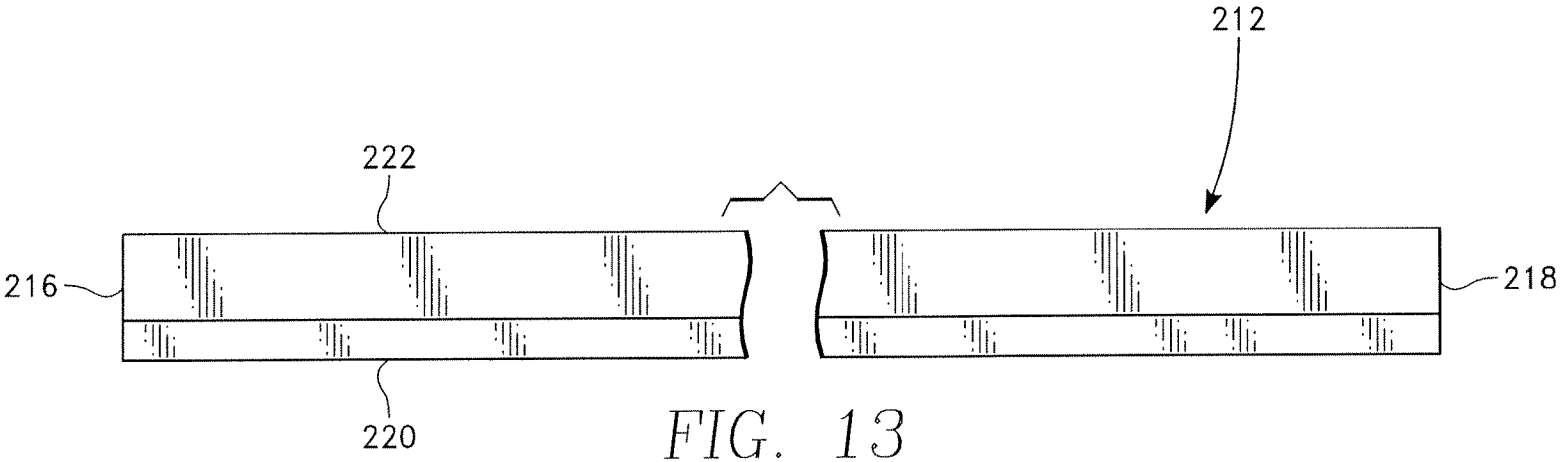
FIG. 13 is a top view of the four inch side loader embodiment of the instant invention.
Figure 14:
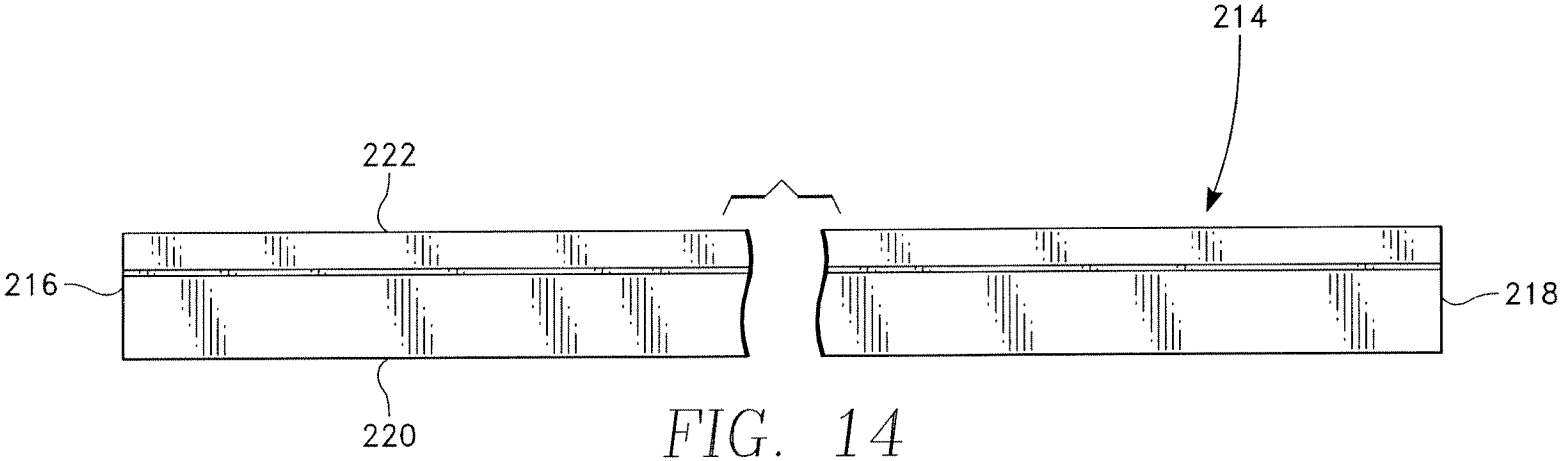
FIG. 14 is a bottom view of the four inch side loader embodiment of the instant invention.
Figure 18:
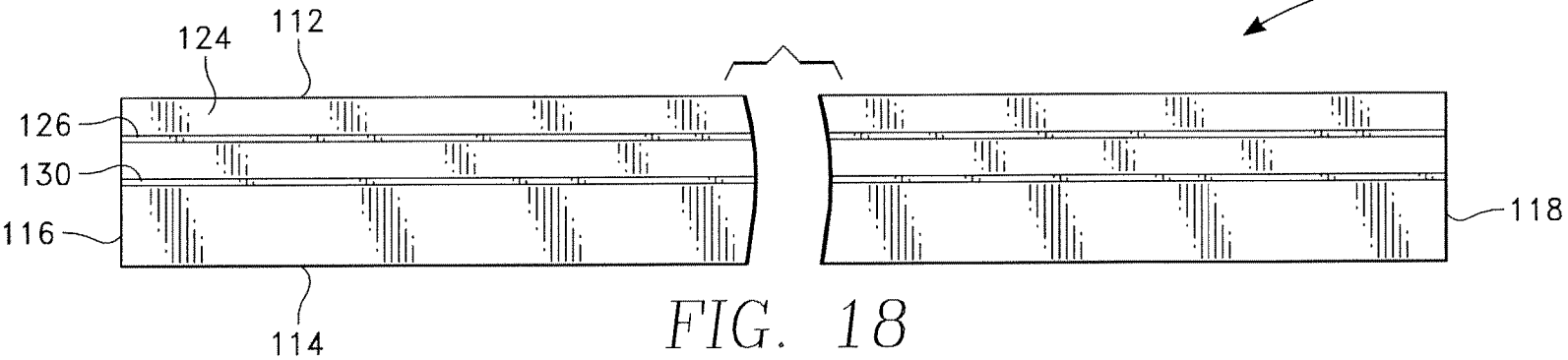
FIG. 18 is a front side view of the two inch top loader embodiment of the instant invention.
Figure 19:
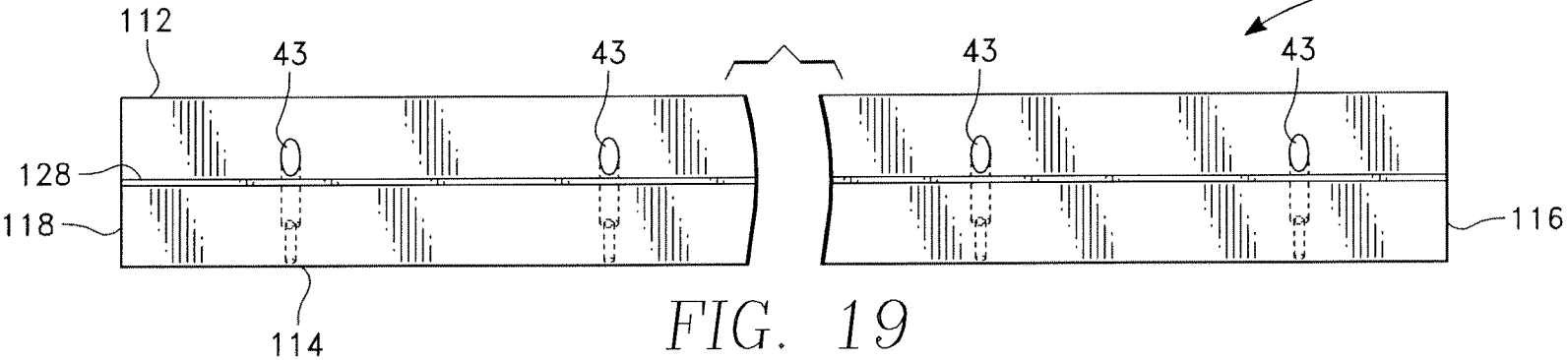
FIG. 19 is a back side view of the two inch top loader embodiment of the instant invention.
Figure 20:
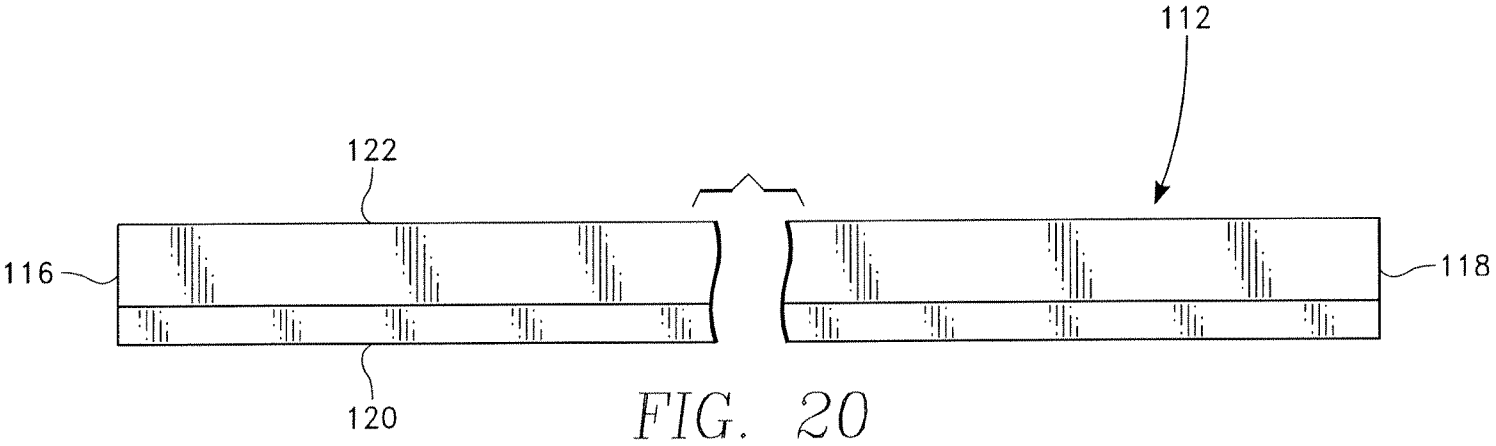
FIG. 20 is a top view of the two inch top loader embodiment of the instant invention.
Figure 21:
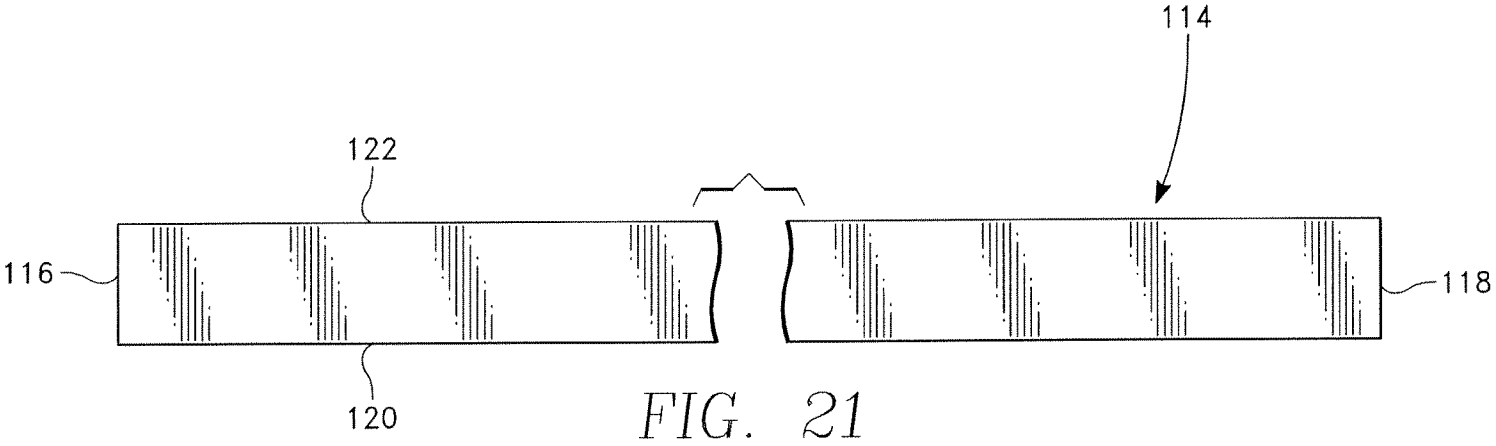
FIG. 21 is a bottom view of the two inch top loader embodiment of the instant invention.
Figures 22, 23, 24:
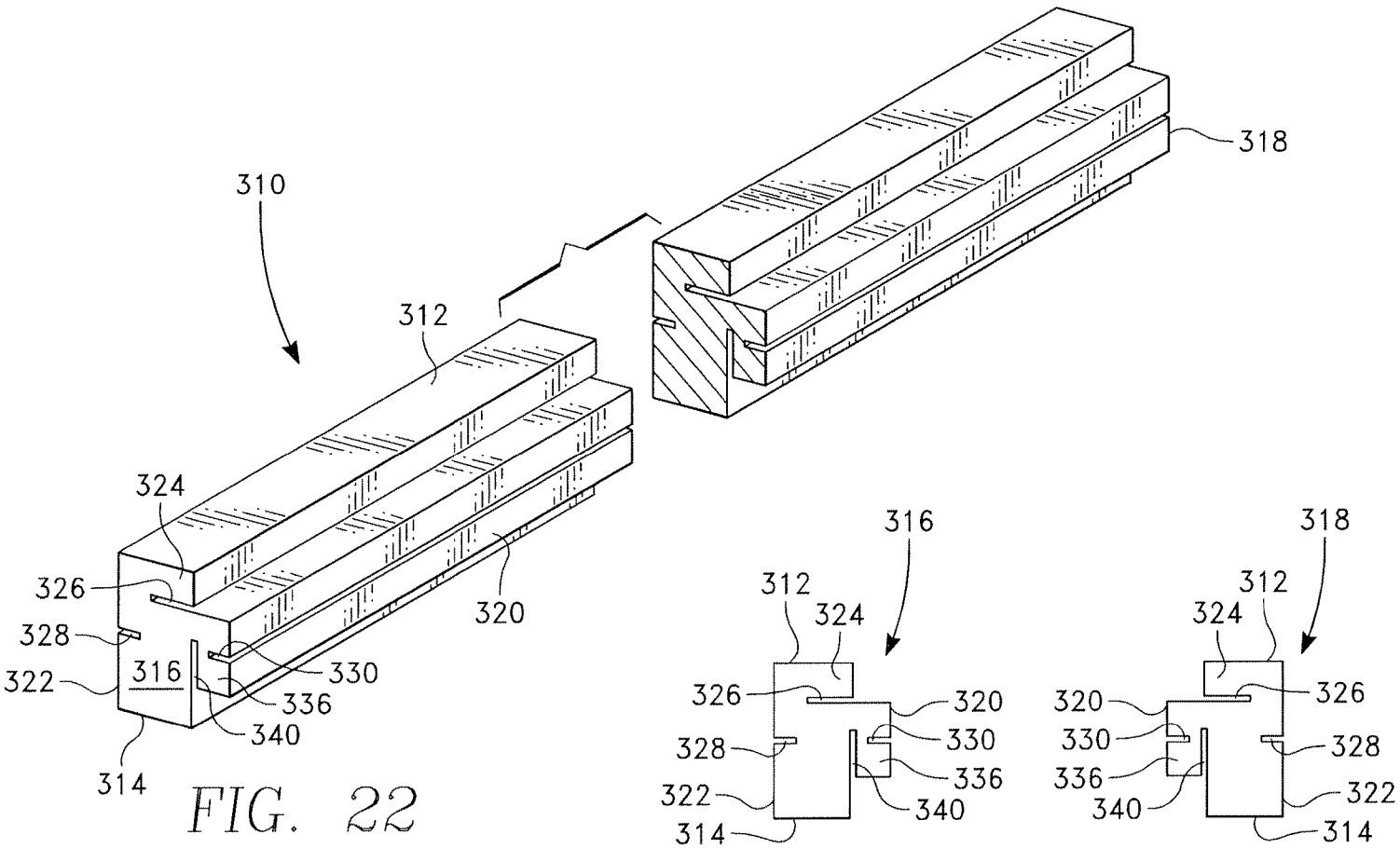
FIG. 22 is a perspective view of the two inch side loader embodiment of the instant invention.
FIG. 23 is a first side view of the two inch side loader embodiment of the instant invention.
FIG. 24 is a second side view of the two inch side loader embodiment of the instant invention.
Figure 25:
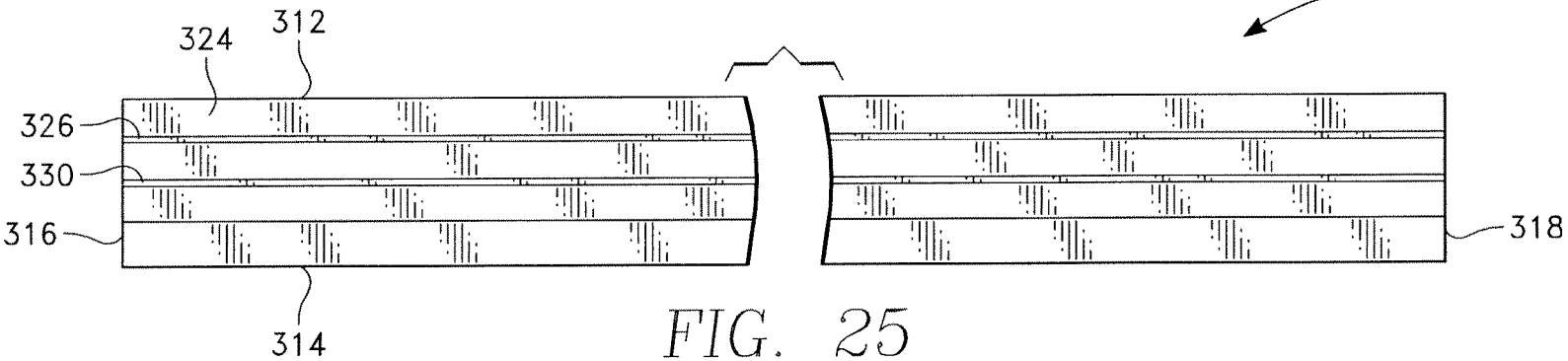
FIG. 25 is a front side view of the two inch side loader embodiment of the instant invention.
Figure 26:
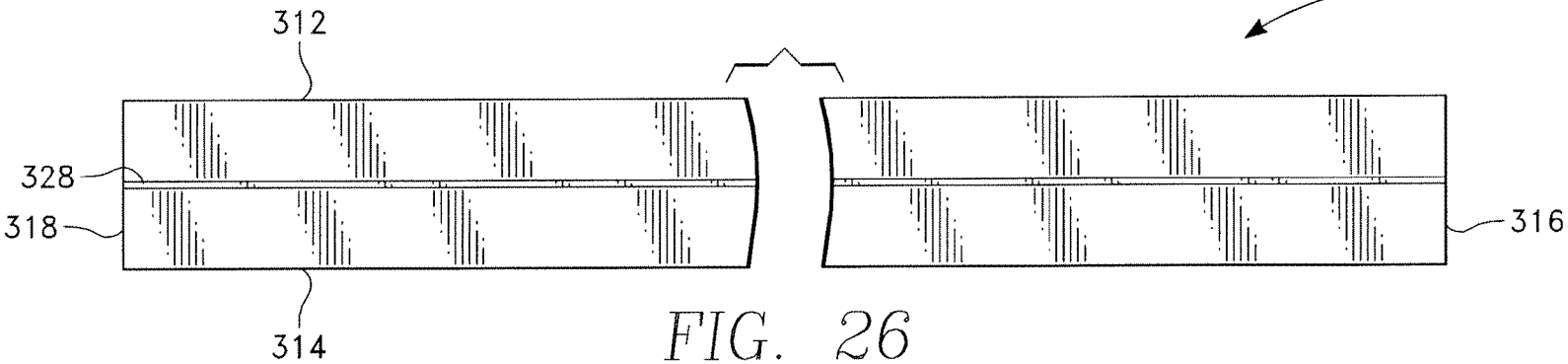
FIG. 26 is a back side view of the two inch side loader embodiment of the instant invention.
Figure 27:
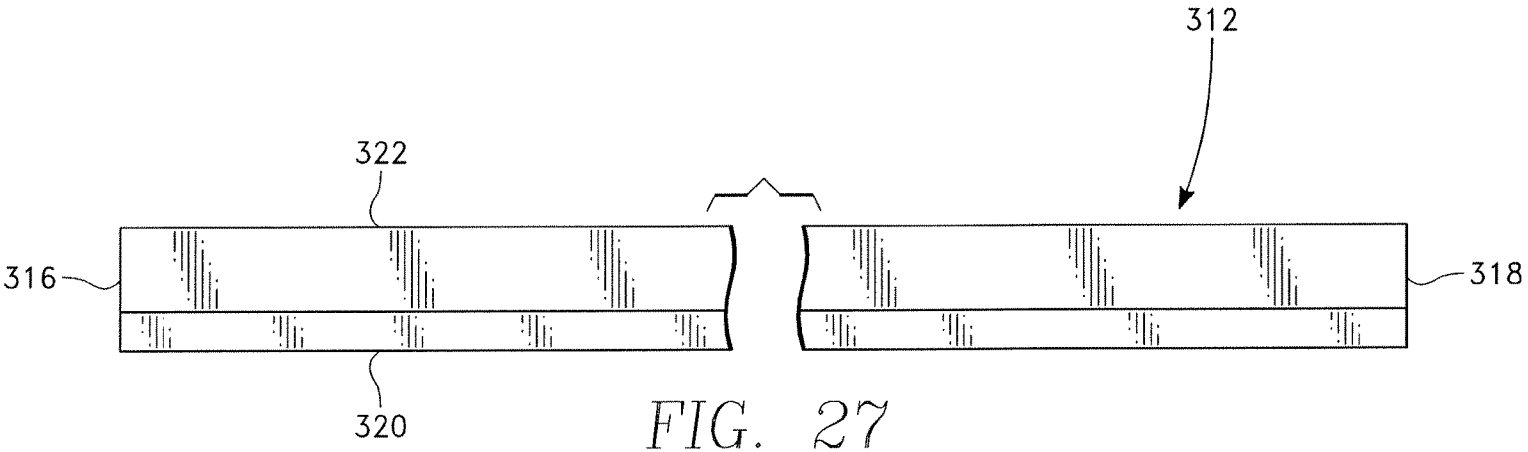
FIG. 27 is a top view of the two inch side loader embodiment of the instant invention.
Figure 28:
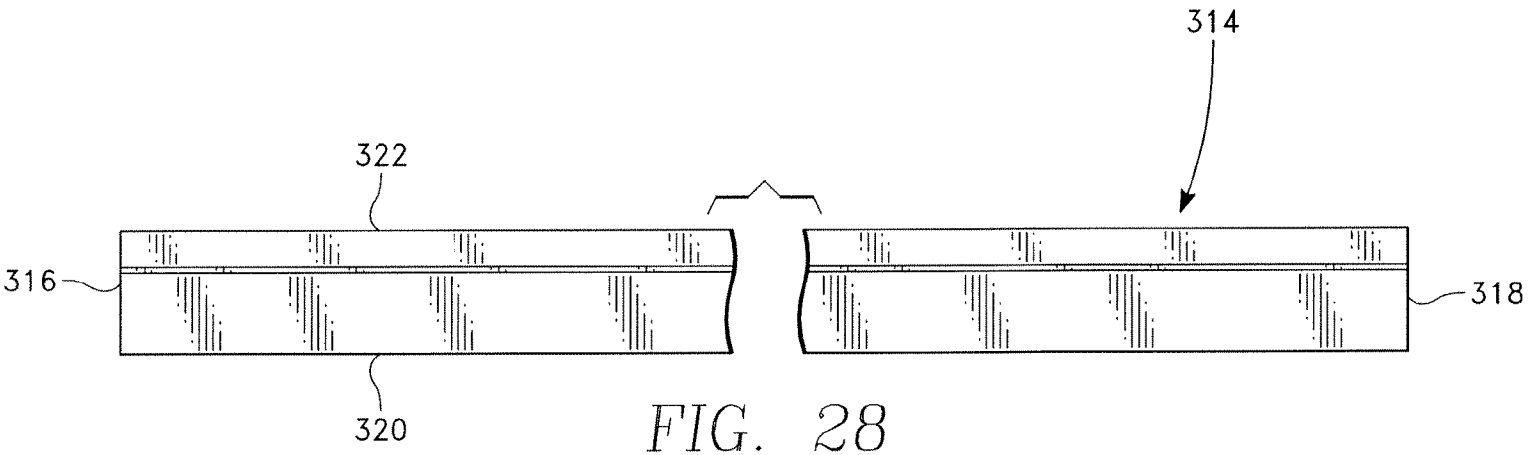
FIG. 28 is a bottom view of the two inch side loader embodiment of the instant invention.

10 4" top load member
12 top side
14 bottom side
16 first side
18 second side
20 front side
22 back side
24 top flange
26 first groove
28 second groove
30 third groove
32 fourth groove
34 fifth groove
36 wall
38 fastening piece
40 latest generation versions of the patent '322 track assembly
42 fabric
43 pocket hole
44 opening aperture for screw
46 entry point for screw
48 screw
50 head of screw
52 stop for screw
54 second aperture for screw
56 exit point for screw
58 puncture point
60 angle axis of entry
110 2" top load member
112 top side
114 bottom side
116 first side
118 second side
120 front side
122 back side
124 top flange
126 first groove
128 second groove
130 third groove
210 4" side loader member
212 top side
214 bottom side
216 first side
218 second side
220 front side
222 back side
224 top flange
226 first groove
228 third groove
230 third groove
232 fourth groove
234 fifth groove
236 bottom flange
240 $6^{th}$ groove, bottom flange
310 2" side loader member
312 top side
314 bottom side
316 first side
318 second side
320 front side
322 back side
324 top flange
326 first groove
328 second groove
330 third groove
336 bottom flange
340 bottom flange groove.

Turning to the drawings, the preferred embodiment is illustrated and described by reference characters that denote similar elements throughout the several views of the instant invention.

The first embodiment provides for the top loading of fabric and is illustrated in both 2 and 4 inch thicknesses. It is to be understood that the invention is not limited to those dimensions and can be modified for numerous thicknesses as desired by a particular job. The top loading embodiment in the 2" dimension is illustrated in FIGS. 15-21, 29. The top loading embodiment in the 4" dimension is illustrated in FIGS. 1-7, 31. The alternate embodiment, which is the side loading embodiment, shown in the 2" dimension is illustrated in FIGS. 22-28, 30. The alternate side loading embodiment in the 4" dimension is illustrated in FIGS. 8-14, 32.

Beginning with FIGS. 1-7 we see all views of the 4" top loading embodiment of the instant invention. In use, we see it attached to a wall 36 in FIG. 31. The top loading embodiment defines a member 10 of indeterminate length depending on the size of the space being covered with fabric. The member 10 has a top side 12, a back side 14, a first end 16, a second end 18, a top side 20 and a bottom side 22. Seen from the side (FIGS. 2-3) it can be seen that the device is fabricated so that a front flange 24 extends outwardly from the substantially rectangular profile that has a height shorter than the rest of the member 10 and has a first groove 26 formed therebetween. Along the top side 20 and bottom side 20 are second and third grooves 28, 30 that run substantially parallel with each other along the length of the member 10 proximate the front flange 24.

Figure 31:
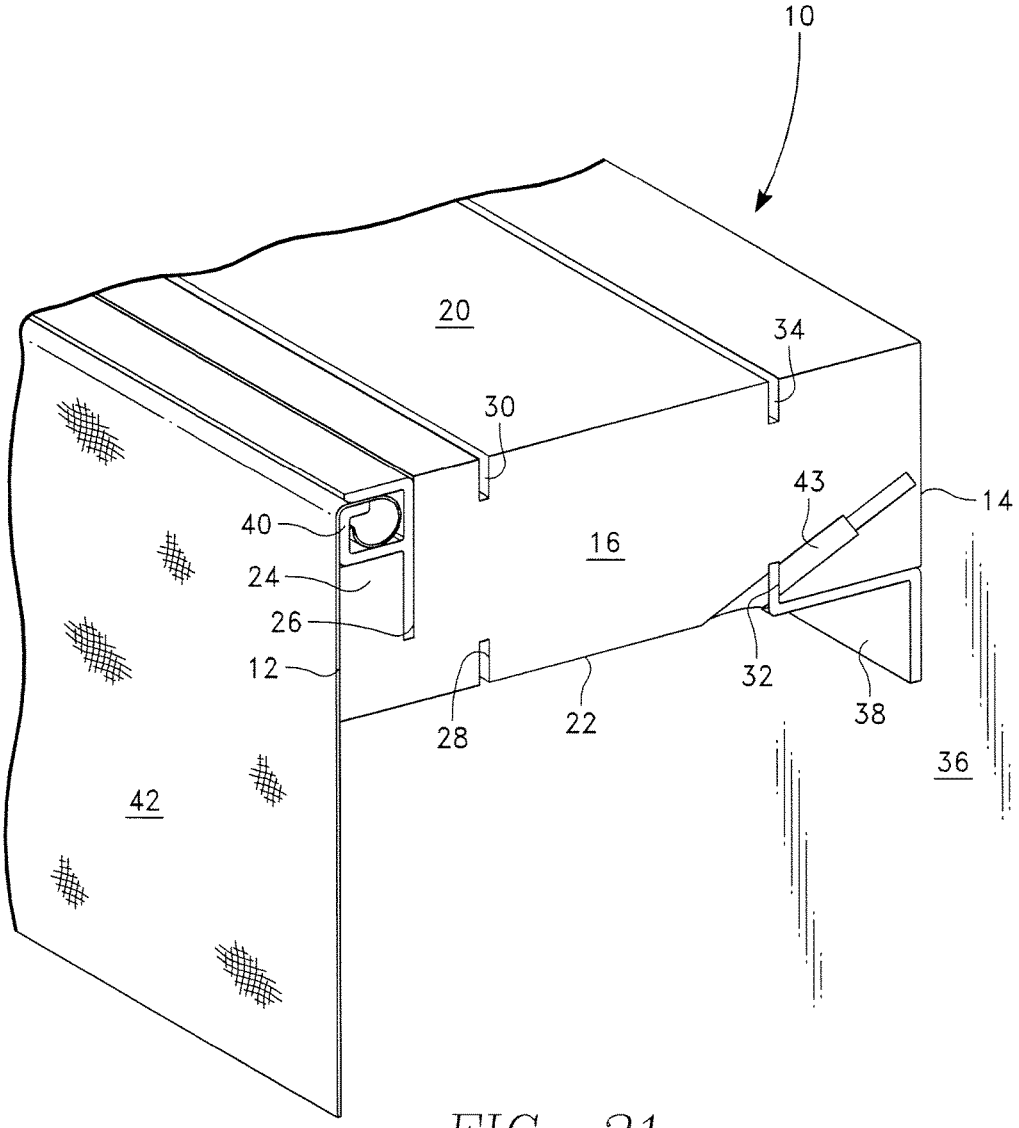
FIG. 31 is a side perspective view of the four inch top loader embodiment attached to a wall with fabric secured therein.

Near the back side 14 of the member 10 is a second set of parallel grooves, labeled fourth groove 32 and fifth groove 34, along the top side 20 and bottom side 22, respectively. In use, as seen in FIG. 31, the back side 14 is secured to a wall 36 with a fastening piece 38 that slides into the $4^{th}$ groove 32 on the bottom side 22 of the member 10, extends along the bottom side 22 of the member and sits ultimately flush against the wall 36. The bottom side 22 and top side 20 run parallel to the ceiling and the floor. Latest generations versions of the the track assembly of the '322 patent 40 fits into the first groove 26 behind the front flange 24 and vertical fabric 42 is secured therein leaving a distance of 4" between the wall 36 and the fabric 42. Second groove 28, third groove 30 and fifth groove 34 allow for additional securing points as desired.

The two inch top loader version 110 is seen in FIGS. 15-21 and 29. It is essentially the same as the four inch member 10 but without the $4^{th}$ and $5^{th}$ grooves with the fastening device being secured in the $2^{nd}$ groove 128. The two inch top loading embodiment defines a member 110 of indeterminate length depending on the size of the space being covered with fabric. The member 110 has a front side 112, a back side 114, a first end 116, a second end 118, a top side 120 and a bottom side 122. Seen from the side (FIGS. 16-17) it can be seen that the device is fabricated so that a front flange 124 extends outward from the substantially rectangular profile that has a height shorter than the rest of the member 110 and has a first groove 126 formed therebetween. Along the top side 120 and bottom side 120 are second and third grooves 128, 130 that run substantially parallel with each other along the length of the member 110 proximate the front flange 124.

Figure 29:
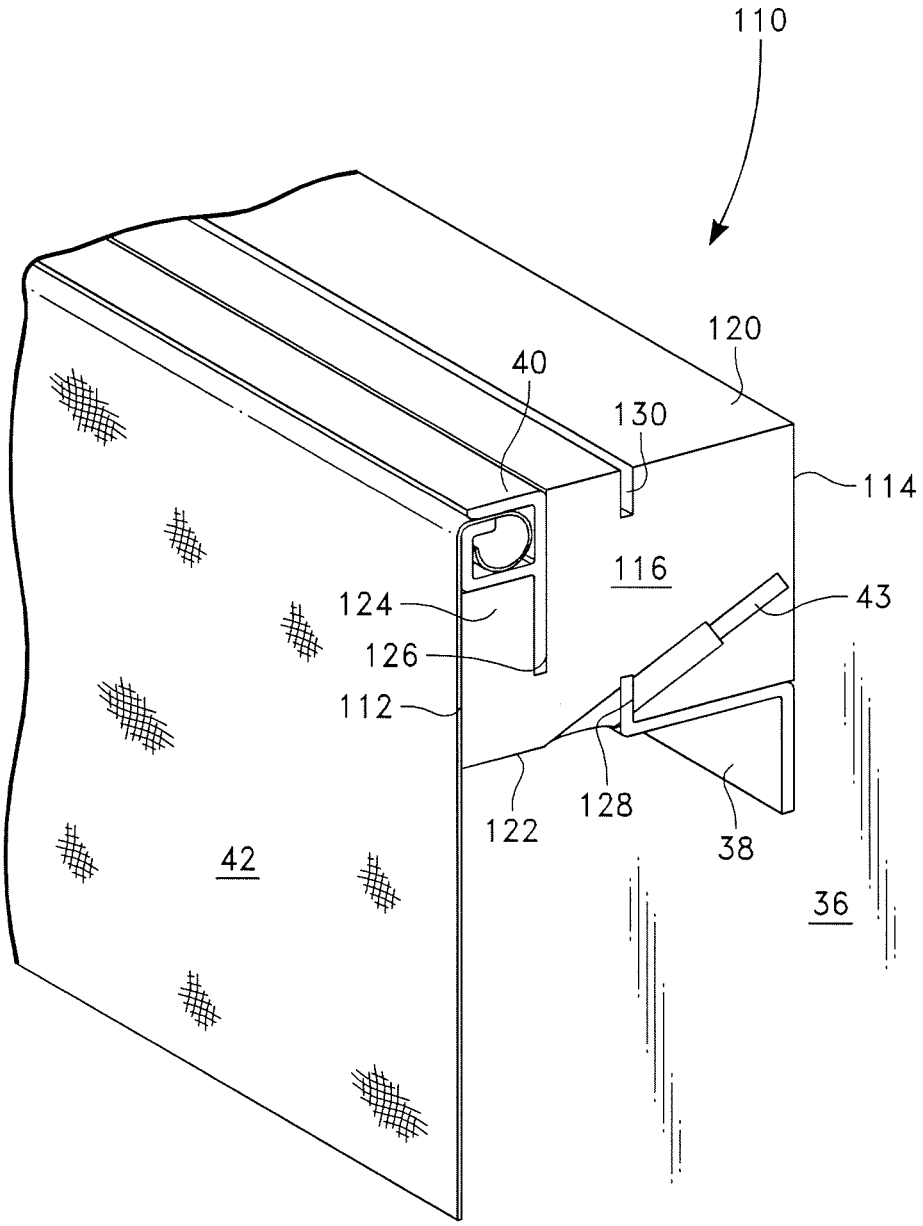
FIG. 29 is a side perspective view of the two inch top loader embodiment attached to a wall with fabric secured therein.

In use, as seen in FIG. 29, the back side 114 is secured to a wall 36 with a fastening piece 38 that slides into the 2nd groove 128 on the bottom side 122 of the member 110 and sits ultimately flush against the wall 36. The bottom side 122 and top side 120 run parallel to the ceiling and the floor. Latest generations of the '322 patent track assembly 40 fits into the first groove 126 behind the front flange 124 and vertical fabric 42 is secured therein leaving a distance of 2" between the wall 36 and the fabric 42. Second groove 128 and third groove 130 allow for additional securing points as desired.

The alternate side loader embodiment in the 4" dimension is illustrated in FIGS. 8-14 and 32. The side loader embodiment 210, in use, can be seen attached to a wall in FIG. 32. The side loading embodiment defines a member 210 of indeterminate length depending on the size of the space being covered with fabric. The member 210 has a front side 212, a back side 214, a first end 216, a second end 218, a top side 220 and a bottom side 222. Seen from the side (FIGS. 9-10) it can be seen that the device is fabricated so that a front flange 224 extends outwardly from the substantially rectangular profile that has a height shorter than the rest of the member 210 and has a first groove 226 formed therebetween. Different from the top loader embodiment is a second top flange 236 with its own groove 240 that is positioned perpendicular to the direction of the front flange 240 along the top side 220. Along the top side 220 and bottom side 220 are the same second and third grooves 228, 230 as seen in the top loader embodiment that run substantially parallel with each other along the length of the member 210 proximate the front flange 224.

Figure 32:
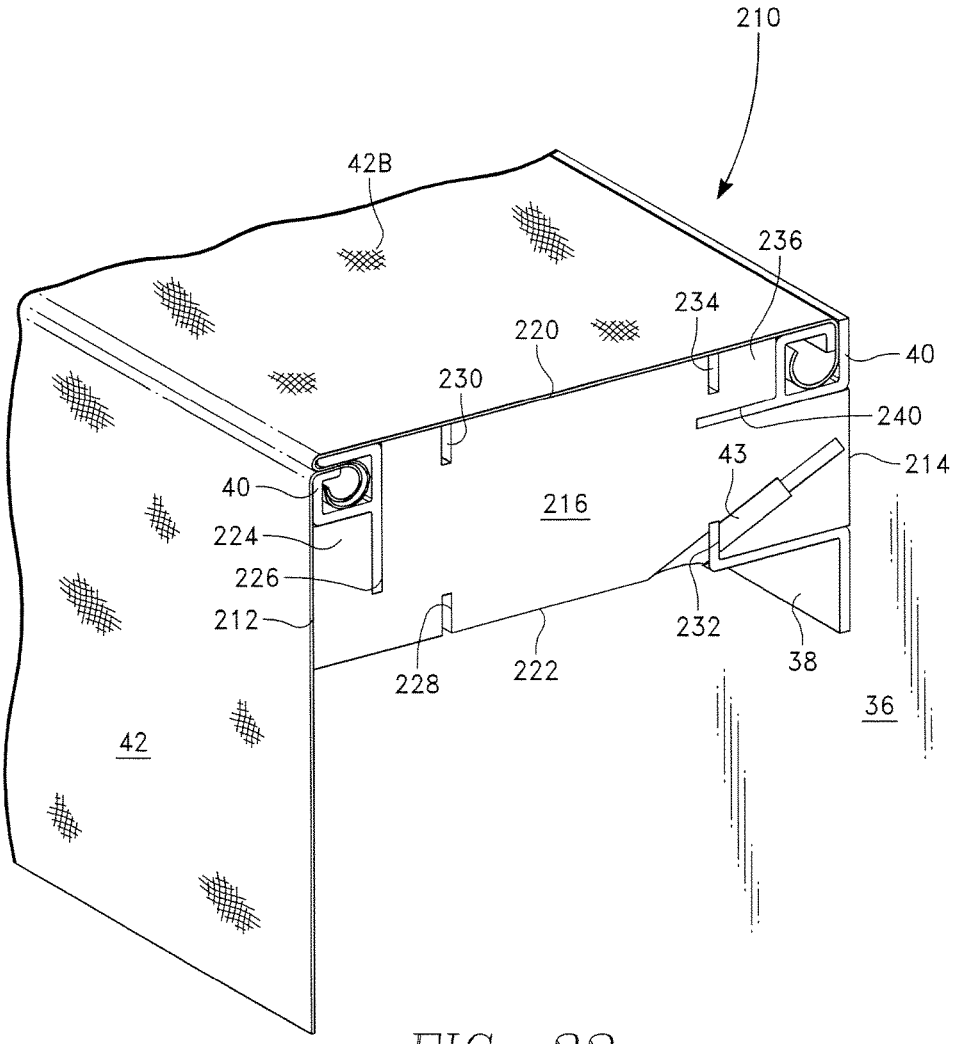
FIG. 32 is a side perspective view of the four inch side loader embodiment attached to wall with fabric secured therein.

Near the back side 214 of the member 210 is a second set of parallel grooves, labeled fourth groove 232 and fifth groove 234, along the top side 220 and bottom side 222, respectively. In use, as seen in FIG. 32, the back side 214 is secured to a wall 36 with a fastening piece 38 that slides into the $4^{th}$ groove 232 on the bottom side 222 of the member 210, extends along the bottom side 222 of the member 210 and sits ultimately flush against the wall 36. The bottom side 222 and top side 220 run parallel to the ceiling and the floor. A first track assembly from latest generations of the patent '322 40 fits into the first groove 26 behind the front flange 224 and vertical fabric 42 is secured therein leaving a distance of 4" between the wall 36 and the fabric 42. A second track assembly from latest generations of the patent '322 40 fits in the $6^{th}$ groove 240 formed by the second top flange 236 and extends horizontally along the stop side 220 of the member 210 and is secured in the first track assembly 40. Second groove 228, third groove 230 and fifth groove 234 allow for additional securing points as desired.

The two inch side loader version 310 is seen in FIGS. 22-28 and 30. It is essentially the same as the four inch member 210 but without the $4^{th}$ and $5^{th}$ grooves with the fastening device being secured in the $2^{nd}$ groove 328. The two inch top loading embodiment defines a member 310 of indeterminate length depending on the size of the space being covered with fabric. The member 310 has a front side 312, a back side 314, a first end 316, a second end 318, a top side 320 and a bottom side 322. Seen from the side (FIGS. 23-24) it can be seen that the device is fabricated so that a front flange 324 extends outward from the substantially rectangular profile that has a height shorter than the rest of the member 310 and has a first groove 326 formed therebetween. Different from the top loader embodiment is a second top flange 336 with its own groove 340 both positioned perpendicular to the direction of the front flange 324 and along the top side 320. Along the top side 320 and bottom side 320 are second and third grooves 328, 330 that run substantially parallel with each other along the length of the member 310 proximate the front flange 324.

Figure 30:
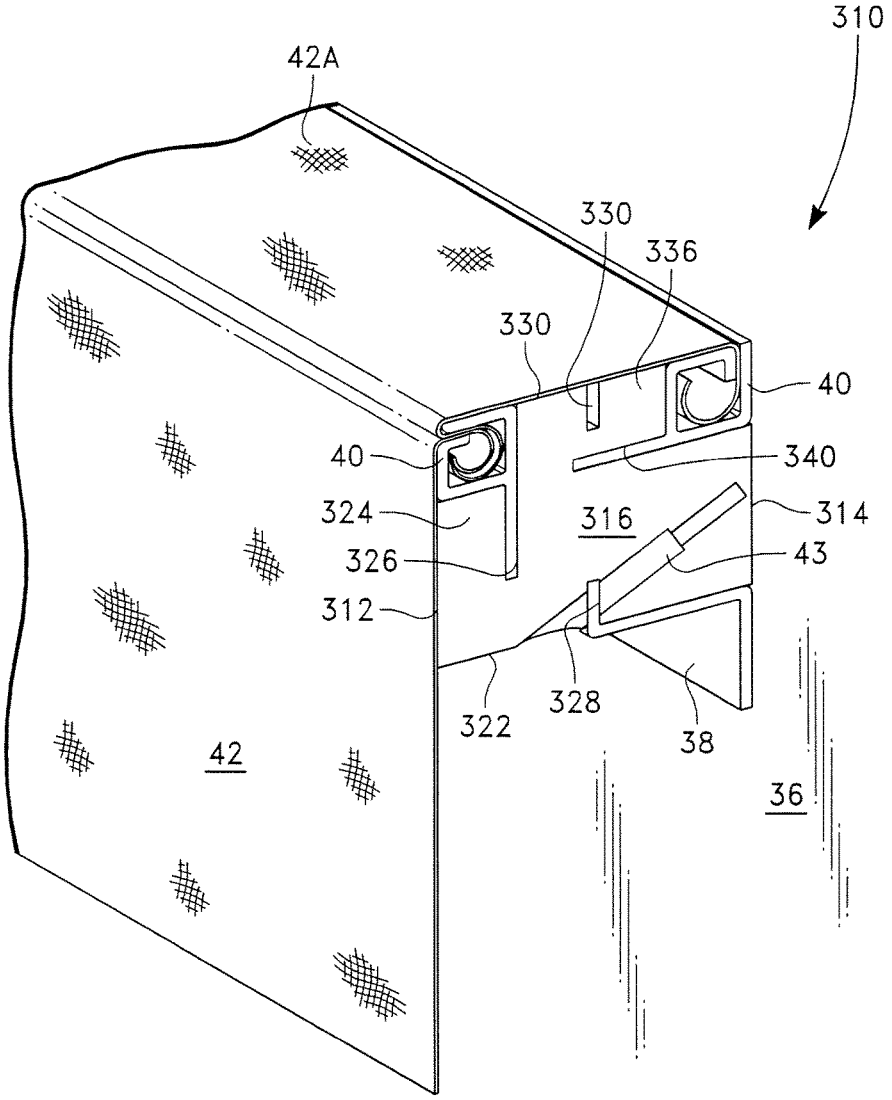
FIG. 30 is a side perspective view of the two inch side loader embodiment attached to wall with fabric secure therein.

In use, as seen in FIG. 30, the back side 314 is secured to a wall 36 with a fastening piece 38 that slides into the 2nd groove 328 on the bottom side 322 of the member 310, extends along the bottom side 322 of the member 310 and sits ultimately flush against the wall 36. The bottom side 322 and top side 320 run parallel to the ceiling and the floor. A first track assembly from latest generations of the '322 patent 40 fits into the first groove 326 behind the front flange 324 and vertical fabric 42 is secured therein leaving a distance of 2" between the wall 36 and the fabric 42. A second track assembly from latest generations of the '322 patent 40 fits in the groove 340 formed by the second bottom flange 336. Fabric 42 is secured in the second top flange 336 and extends horizontally along the top side 320 of the member 310 and is secured in the first track assembly 40. Second groove 328 and third groove 330 allow for additional securing points as desired.

Figure 33A:
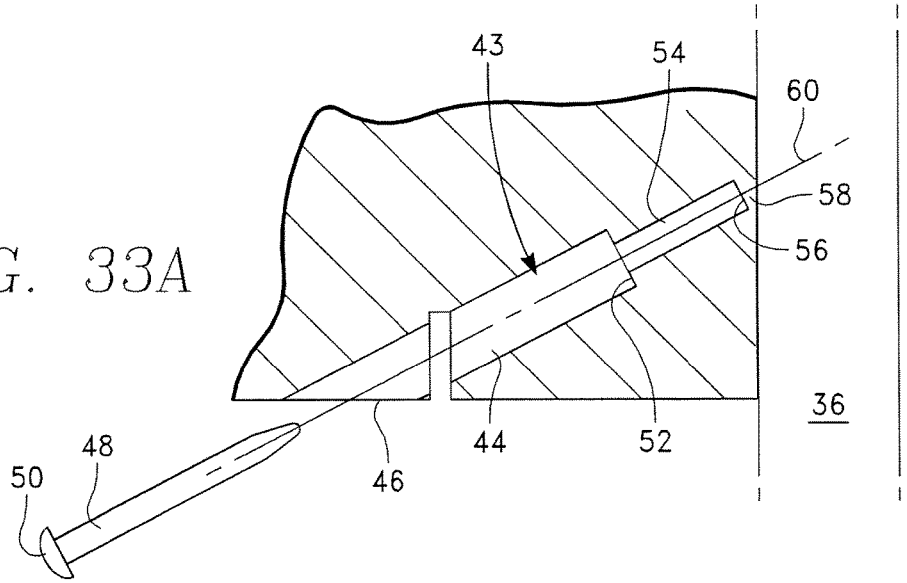
FIG. 33A is a close up view of the mounting pocket hole of the instant invention.
Figure 33B:
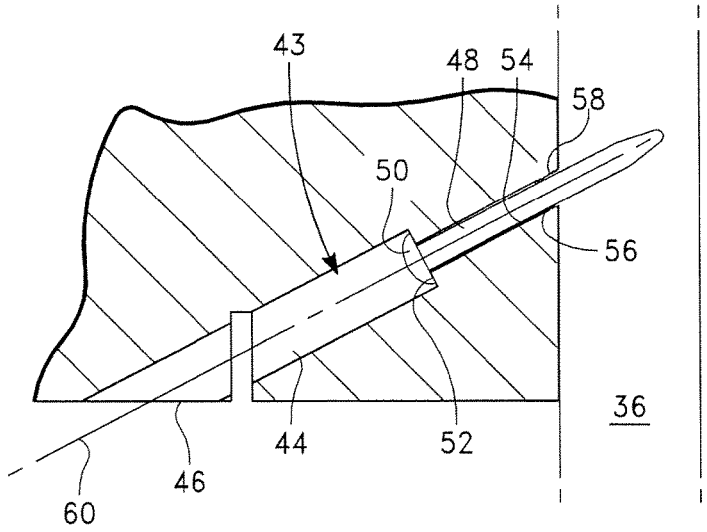
FIG. 33B is the view shown in FIG. 33A but with a screw secured therein.

Seen throughout the figures and shown in close-up in FIGS. 33A and 33B, an alternate mounting means includes a pocket hole 43. The pocket hole 43 has an angled axis 60 allowing for the placement of a screw 48 therein to mount the member to a wall 36. Beginning at the bottom side 14, 114, 214, 314 of a given member 10, 110, 210, 310 there is an opening aperture 44 for the placement therein of a mounting screw 48. The screw 48 enters the opening aperture 44 at a the entry point 46 and moves along the angled axis 60 until the head 50 of the screw reaches the stop 52. The rest of the screw 48 continues into the second aperture 54 until it hits the exit point 56 which is also the puncture point 58 of the member 10, 110, 210, 310 that allows the member 10, 110, 210, 310 to be secured to the wall 36.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An expander device for use with fastening track for fabric wall coverings comprising:

an elongated main body that has a substantially rectangular profile and further comprising a front side, a back side, a first end, a second end, a top side and a bottom side; and a front flange extending outward from said front side and having a height that is shorter than said front side and offset slightly therefrom thereby creating a first flange groove therebetween;

at least one set of parallel grooves running parallel to each other along said top side and bottom side respectively further comprising a securing piece for securing said device to a wall, said securing piece comprising a first side that is substantially planar attached to a second side that is substantially planar and positioned substantially perpendicular to said first side along one edge of said first side and a third side that is substantially planar and positioned substantially perpendicular to said second side along an opposite parallel side from said first side and substantially parallel to said first side yet extending upward in the direction opposite of the direction between said first and second sides wherein said third side fits into one of said parallel grooves on said bottom side of said member and said first side is secured to a wall or other planar surface.

2. An expander device for use with fastening track for fabric wall coverings comprising:

an elongated main body that has a substantially rectangular profile and that is a solid piece within said substantially rectangular profile and further comprising a front side, a back side, a first end, a second end, a top side and a bottom side wherein said back side is the attachment point to a wall and wherein said front side is where fabric wall coverings are visibly seen to extend downwardly therefrom; and a front flange extending outward from said front side and having a height that is shorter than said front side and offset slightly therefrom thereby creating a first flange groove therebetween wherein a second top flange positioned substantially perpendicular to said front flange and positioned proximate said top side having a length shorter than the length of said top side and offset slightly therefrom thereby creating a second flange groove therebetween.

3. The expander device as defined in claim 2 wherein a fastening track is placed in said second top flange groove thereby allowing for the securing of fabric therein wherein said fabric extends horizontally across said top side.

* * * * *